US008632203B2

(12) United States Patent
Kim

(10) Patent No.: US 8,632,203 B2
(45) Date of Patent: Jan. 21, 2014

(54) LIGHTING DEVICE WITH REMOVABLE CLIP

(75) Inventor: Paul Y. Kim, Santa Ana, CA (US)

(73) Assignee: SureFire, LLC, Fountain Valley, CA (US)

( * ) Notice: Subject to any disclaimer, the term of this patent is extended or adjusted under 35 U.S.C. 154(b) by 405 days.

(21) Appl. No.: 13/006,074

(22) Filed: Jan. 13, 2011

(65) Prior Publication Data

US 2011/0176294 A1 Jul. 21, 2011

Related U.S. Application Data

(60) Provisional application No. 61/295,293, filed on Jan. 15, 2010.

(51) Int. Cl.
*F21V 33/00* (2006.01)

(52) U.S. Cl.
USPC ..... 362/109; 362/171; 362/191; 362/202

(58) Field of Classification Search
USPC ..... 362/105, 106, 109, 110, 171, 191, 202
See application file for complete search history.

(56) References Cited

U.S. PATENT DOCUMENTS

| | | | | |
|---|---|---|---|---|
| 4,506,317 | A * | 3/1985 | Duddy | 362/396 |
| 5,276,596 | A * | 1/1994 | Krenzel | 362/191 |
| 5,440,465 | A * | 8/1995 | Hasness | 362/191 |
| D537,969 | S | 3/2007 | Moser | |
| 7,278,764 | B2 | 10/2007 | Kim | |
| D574,529 | S | 8/2008 | Squires et al. | |
| D597,690 | S | 8/2009 | Yamamoto | |
| D605,799 | S | 12/2009 | Kim | |
| D608,923 | S | 1/2010 | Yamamoto | |
| D612,968 | S | 3/2010 | Ma | |
| D624,678 | S | 9/2010 | Kim | |
| 2004/0246712 | A1* | 12/2004 | Endo | 362/190 |
| 2010/0165612 | A1* | 7/2010 | Yeh | 362/190 |

* cited by examiner

*Primary Examiner* — David V Bruce
(74) *Attorney, Agent, or Firm* — Haynes and Boone, LLP

(57) ABSTRACT

A light producing device, such as a flashlight, may have a clip that is removably attached to a body thereof. The clip may comprise a split ring that substantially encircles the body and has a split therein and may also comprise an elongated portion having a proximal end and a distal end. The elongated portion may be attached to the split ring substantially opposite the split. The clip may be readily removed from the body, such as to better facilitate hand holding of the light producing device, to facilitate maintenance or repair of the light producing device, and/or for storage/transportation of the light producing device.

20 Claims, 15 Drawing Sheets

LIGHTING DEVICE WITH REMOVABLE CLIP

CROSS-REFERENCE TO RELATED APPLICATIONS

This application claims the benefit of U.S. Provisional Patent Application No. 61/295,293 filed Jan. 15, 2010, which is incorporated herein by reference in its entirety.

BACKGROUND

1. Field of the Invention

The present invention generally relates to light producing devices and more particularly relates to light producing devices having clips to facilitate attachment of such devices.

2. Related Art

As is well known, light producing devices such as flashlights are typically configured to be hand held. Light producing devices may also be configured to attach to an article of clothing such as a user's shirt pocket, helmet, or belt. Light producing devices may be configured to attach to a weapon, such as a firearm. A clip may be used to facilitate the attachment of a light producing device to an article of clothing or to facilitate the mounting of a light producing device to a weapon or the like.

Unfortunately, the contemporary clips used to facilitate such attachment have various limitations. In some instances, it may be beneficial to remove the clip from the light producing device. This may be useful to better facilitate hand holding of the light producing device, to facilitate maintenance or repair of the light producing device, or for storage/transportation of the light producing device, for example.

However, contemporary clips may be difficult to remove. Moreover, many contemporary flashlights have a tail cap at the back end thereof. The use of such a tail cap makes it difficult to provide a removable clip and thus undesirably inhibits the replacement of parts. Accordingly, there is a need for an improved lighting device that overcomes one or more of the deficiencies discussed above.

SUMMARY

According to an embodiment, a light producing device may have a removable clip. The use of such a clip may enhance the utility of the light producing device by more readily allowing the light producing device to be reconfigured for different uses and may more readily facilitate maintenance, repair, storage, and transportation of the light producing device.

According to an embodiment, a light producing device may have a body, a light source attached to the body, and a power source contained substantially within the body. The light source may be configured to provide power to the light source. Alternatively, the light source may be partially or entirely outside of the body.

According to an embodiment, the clip may be removably attached to the body. The clip may comprise a split ring that substantially encircles the body and has a gap or split therein and may also comprise an elongated portion having a proximal end and a distal end. The split may be enlarged by manipulating the clip to facilitate removal of the clip from the light producing device. The elongated portion may be joined to the split ring at a location on the split ring that is substantially opposite the split.

According to an embodiment, a method for making a light producing device may comprise providing a body, attaching a light source to the body, and removably attaching a clip to the body. The clip may comprise a split ring configured to substantially encircle the body and having a split therein and an elongated portion having a proximal end and a distal end. The elongated portion may be attached to the split ring substantially opposite the split.

According to an embodiment, a clip for a light producing device may comprise a split ring configured to substantially encircle the light producing device and having a split therein and an elongated portion having a proximal end and a distal end. The elongated portion may be attached to the split ring substantially opposite the split. The clip may be configured to be removed from the light producing device by pushing the distal end of the clip toward the light producing device and/or pulling the distal end of the clip away from the light producing device.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
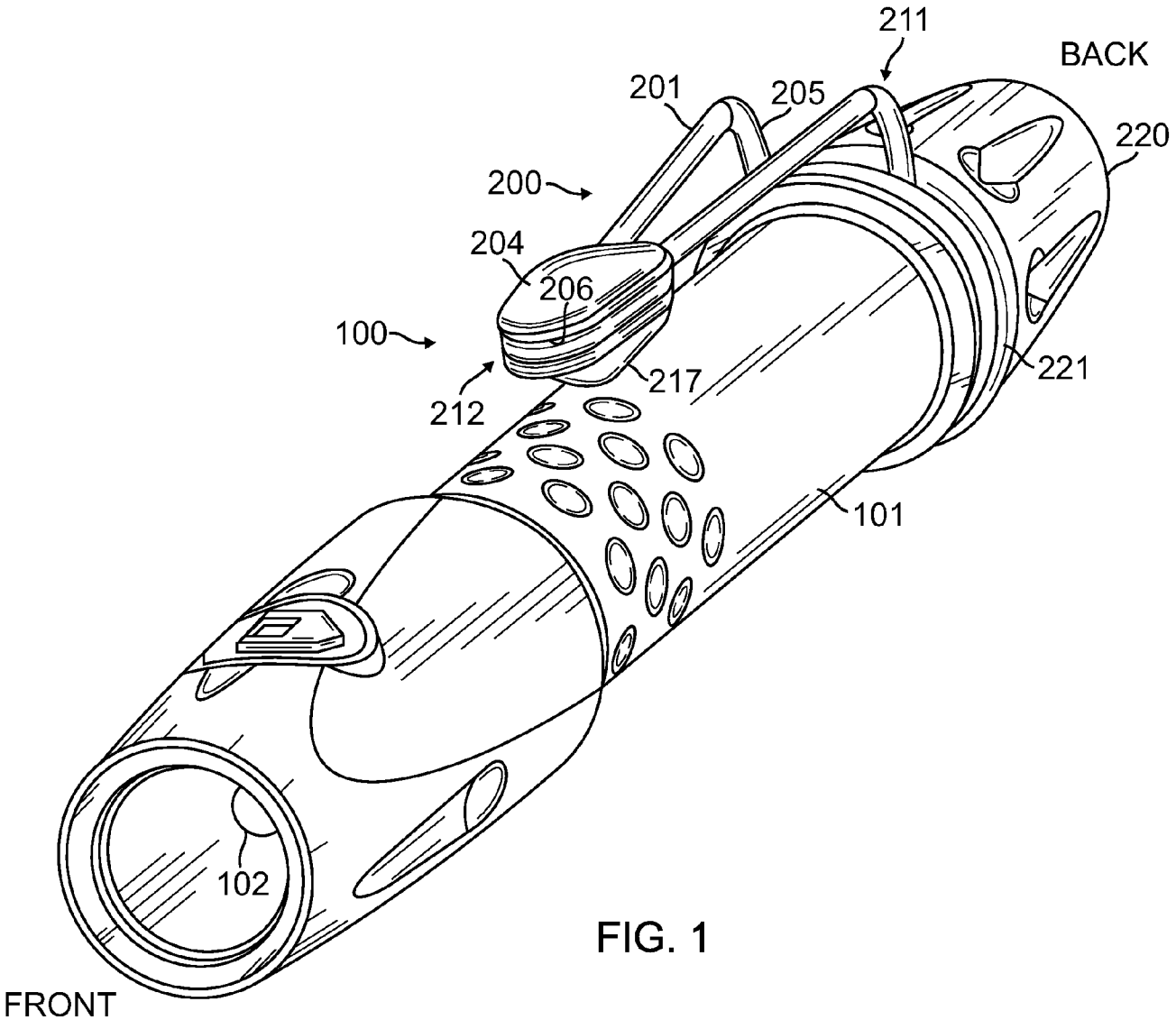
FIGS. 1-8 show a first configuration of a light producing device having a removable clip, in accordance with an embodiment of the invention.
Figure 2:
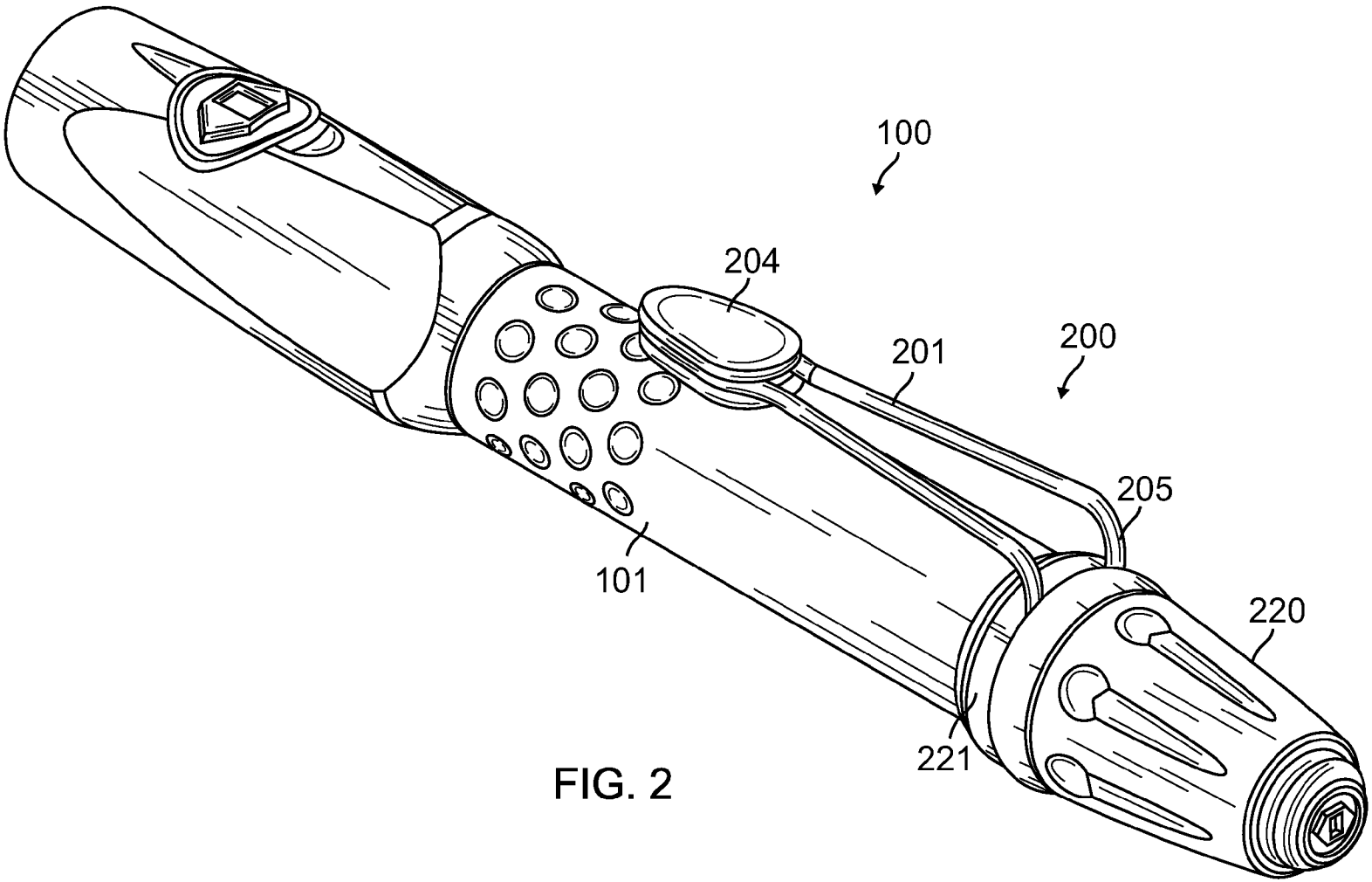
Figure 3:
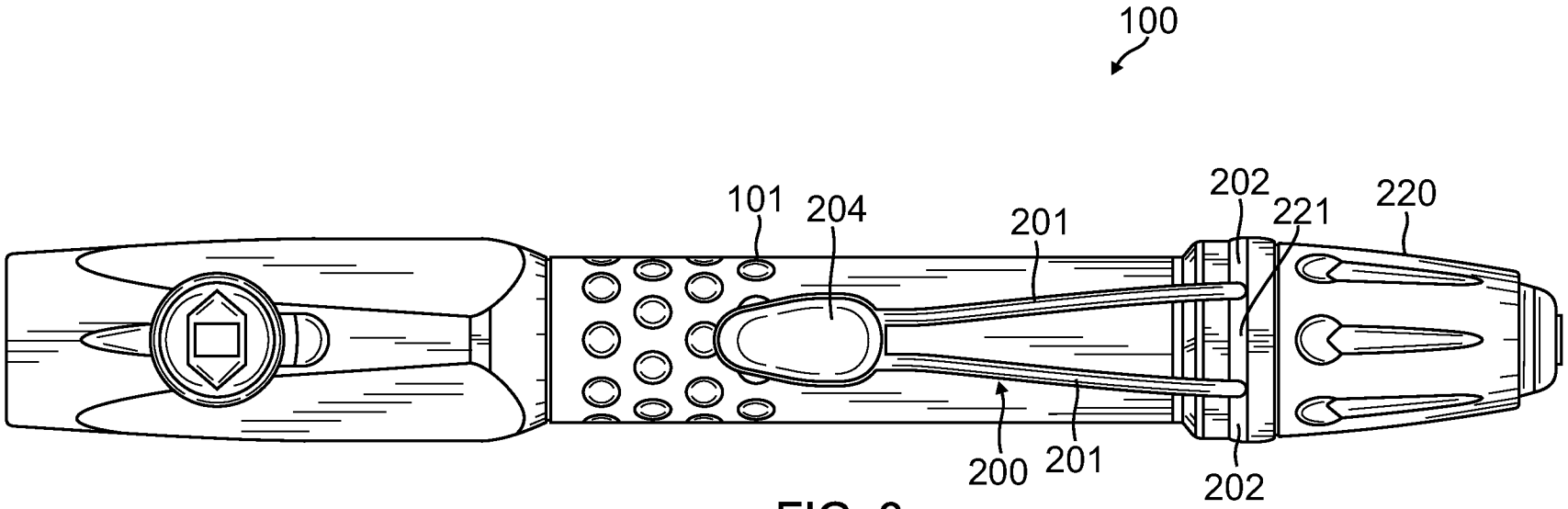
Figure 4:
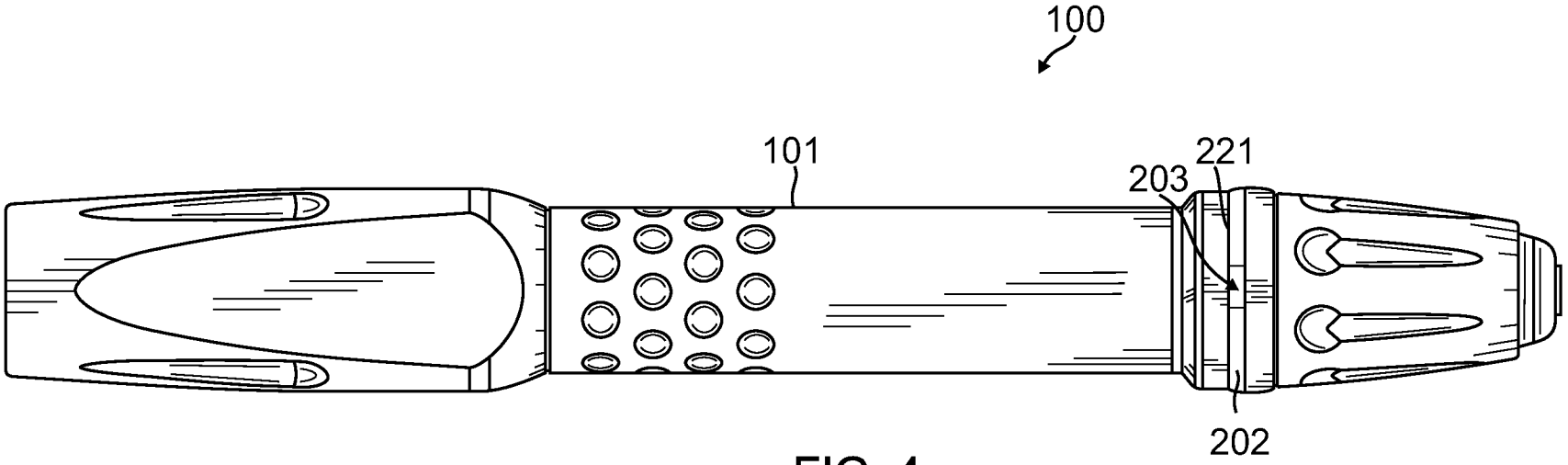
Figure 5:
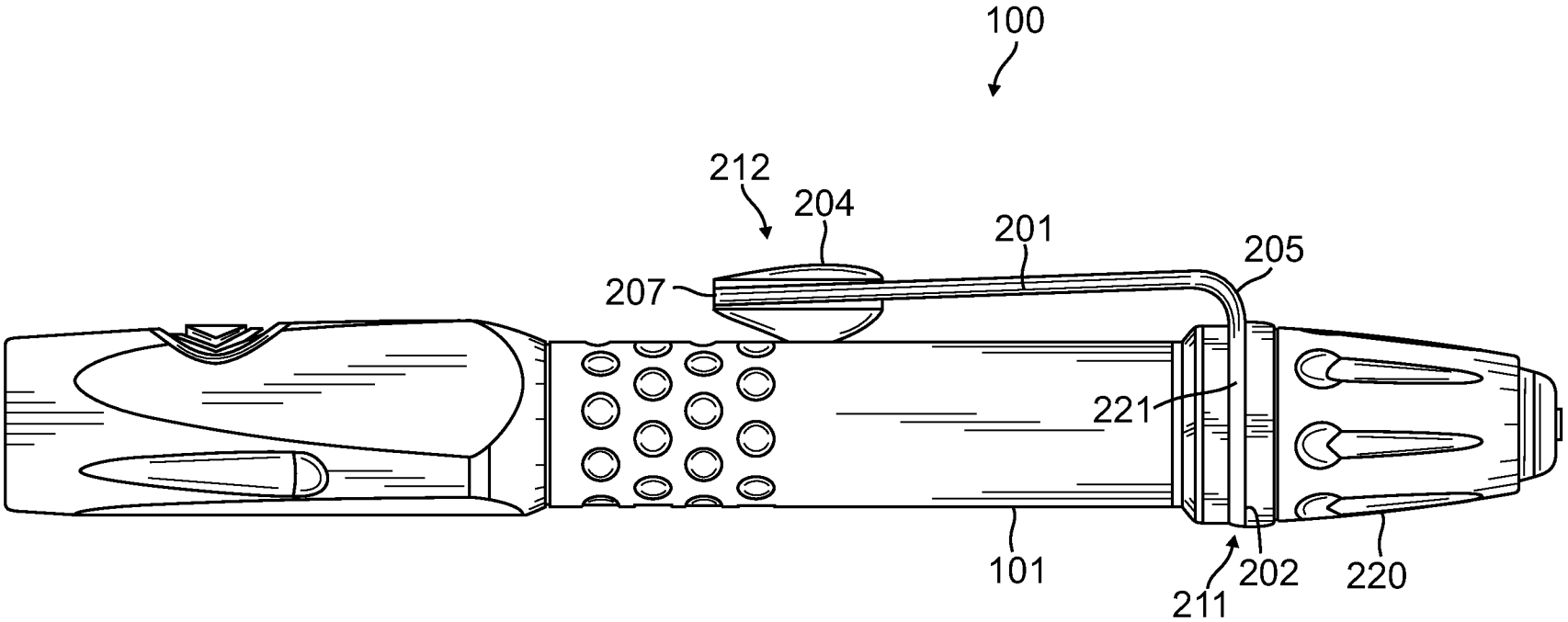
Figure 6:
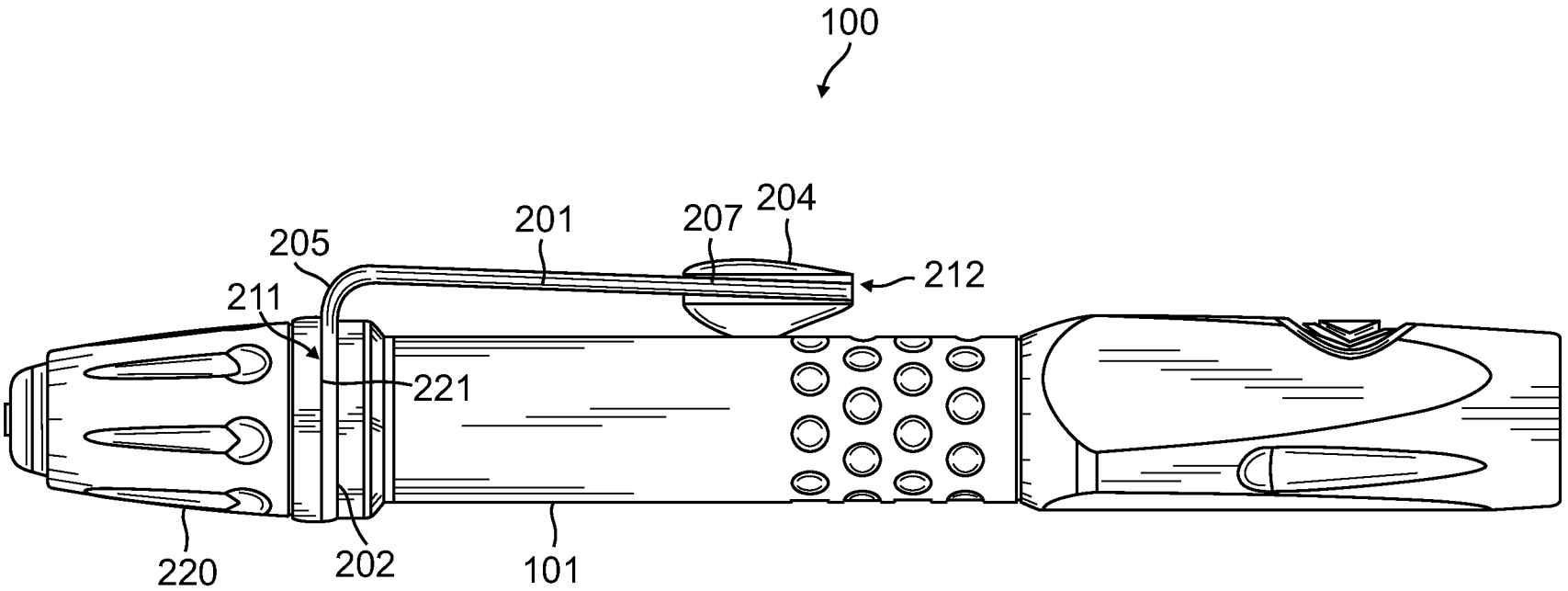

In accordance with various embodiments provided herein, a light producing device may have a removable clip that may easily be removed to reconfigure the light producing device for different uses and may more readily facility maintenance, repair, storage, and/or transportation of the light producing device. The clip may also be easily replaced for the light producing device.

The clip may define a belt clip. The clip may define a shirt pocket clip, a helmet clip, a weapon mounting clip, or any other desired type of clip. The clip may be any device or structure that facilitates attachment of the light producing device to any other item.

According to an embodiment, different types of clips may be provided. Thus, one type of clip may be removed and another type of clip may be attached in its place. For example, a clothing clip may be removed and a weapon mount clip may be attached in place of the clothing clip. The easier it is to remove and replace such clips, the more the utility of the light producing device is enhanced.

According to an embodiment, a light producing device may have a body, a light source attached to the body, and a power source configured to provide power to the light source. A clip may be removably attached to the body. The clip may comprise a split ring that substantially encircles the body and has a split therein and may also comprise an elongated portion having a proximal end and a distal end. The elongated portion may be attached to the split ring substantially opposite the split. The elongated portion may be attached to the split ring at any other desired location. The elongated portion may be attached to the split ring at any desired orientation with respect to the split ring.

According to an embodiment, the light producing device may be configured such that pushing the distal end of the elongated portion toward the body causes the split to open further so as to facilitate removal of the clip from the body. For example, the distal end of the elongated portion may be pushed toward the body by squeezing the distal end of the elongated portion and the body, such as between the thumb and forefinger of one of the user's hands, for example.

According to an embodiment, the light producing device may be configured such that pulling the distal end of the elongated portion away from the body causes the split to open further so as to facilitate removal of the clip from the body. For example, the distal end of the elongated portion may be pulled away from the body by grasping the body, grasping the elongated portion, and pulling the body and the elongated portion away from one another.

According to an embodiment, the light producing device may be configured such that pushing the distal end of the elongated portion toward the body causes the split to open further so as to facilitate removal of the clip from the body and also so that pulling the distal end of the elongated portion away from the body causes the split to open further so as to facilitate removal of the clip from the body. Thus, the distal end of the elongated portion may either be pushed toward the body or pulled away from the body to remove the clip. In this instance, the user may choose how to remove the clip from the body.

According to an embodiment, the body of the light producing device may include a groove within which the split ring is at least partially disposed. That is, the split ring may be at least partially seated within the groove. The groove may extend entirely around a substantial portion of the body. The groove may extend partially around the body. For example, the groove may be absent where the split of the split ring is disposed (thus defining a piece of the body that may be disposed within the split, for example).

The groove may be defined entirely by the body of the light producing device. The groove may be defined entirely by structures that are not part of the body. The groove may be defined by any combination of the body and structures that are not part of the body.

According to an embodiment, the clip may be made at least partially from single continuous piece of material, such as wire. For example, the clip may be at least partially formed from a single section of spring steel wire. Optionally, a pad may be disposed proximate the distal end of the clip.

Figure 7:
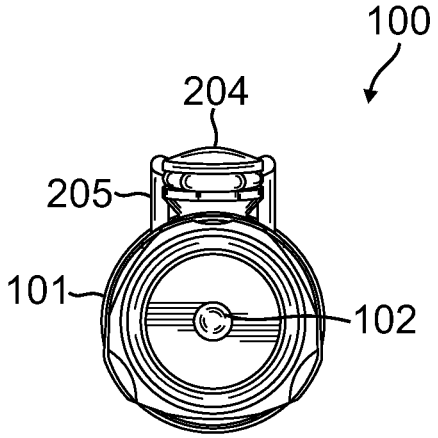
Figure 8:
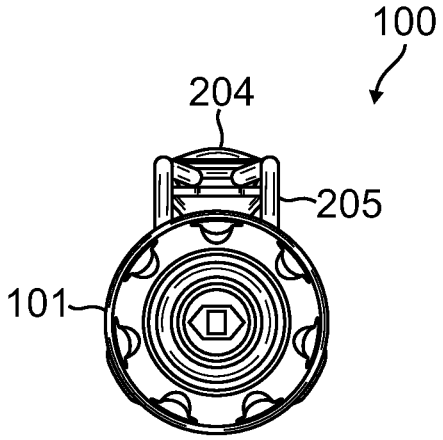

Referring now to FIGS. 1-8, a first configuration of a light producing device 100 is shown according to an embodiment. The light producing device 100 may comprise a body 101 to which a light source 102 (as shown in FIGS. 1 and 7) is attached. In one embodiment, the light source 102 may be a light emitting diode (LED).

Figure 9:
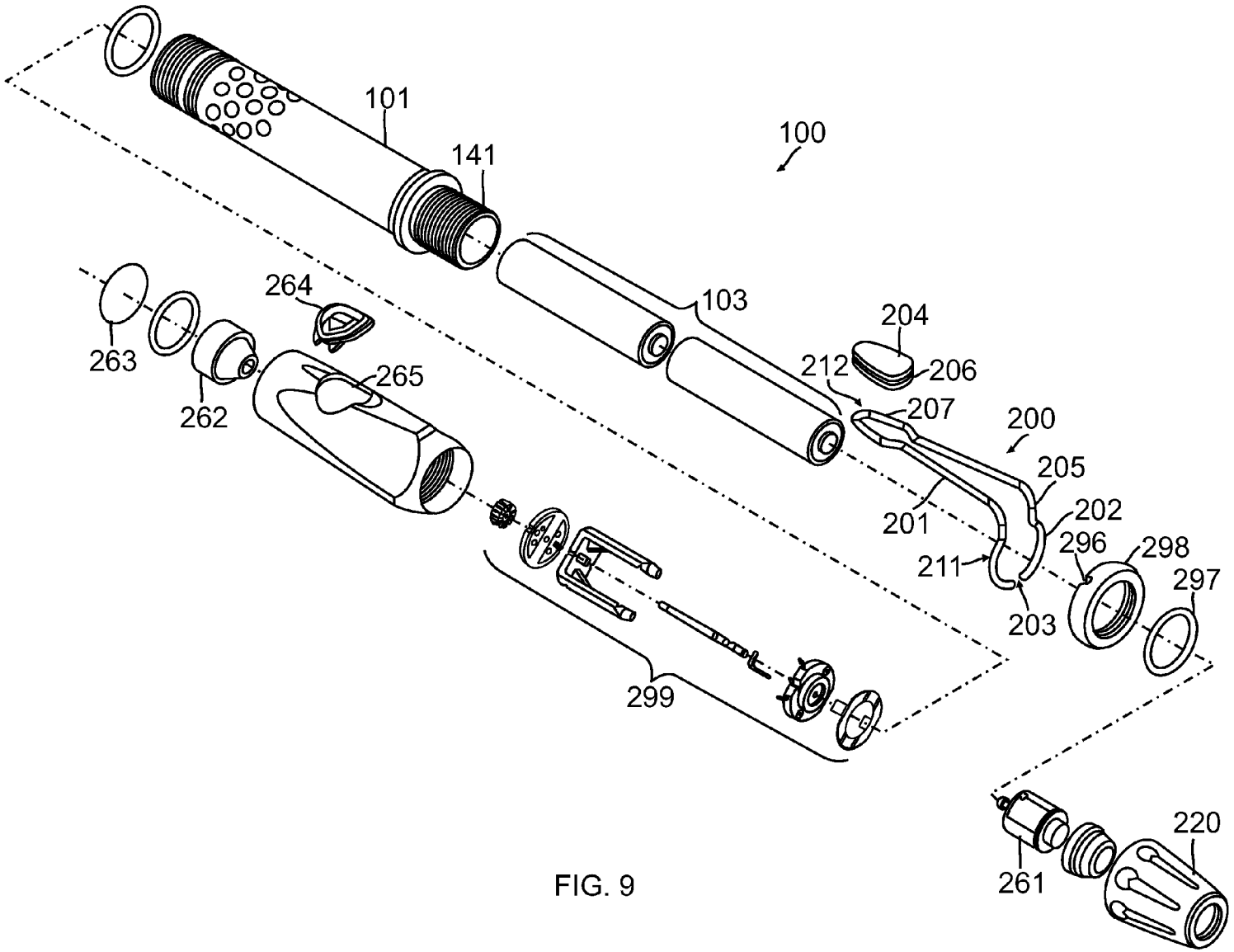
FIG. 9 is an exploded perspective view of a light producing device having a removable clip, in accordance with an embodiment of the invention.
Figure 10:
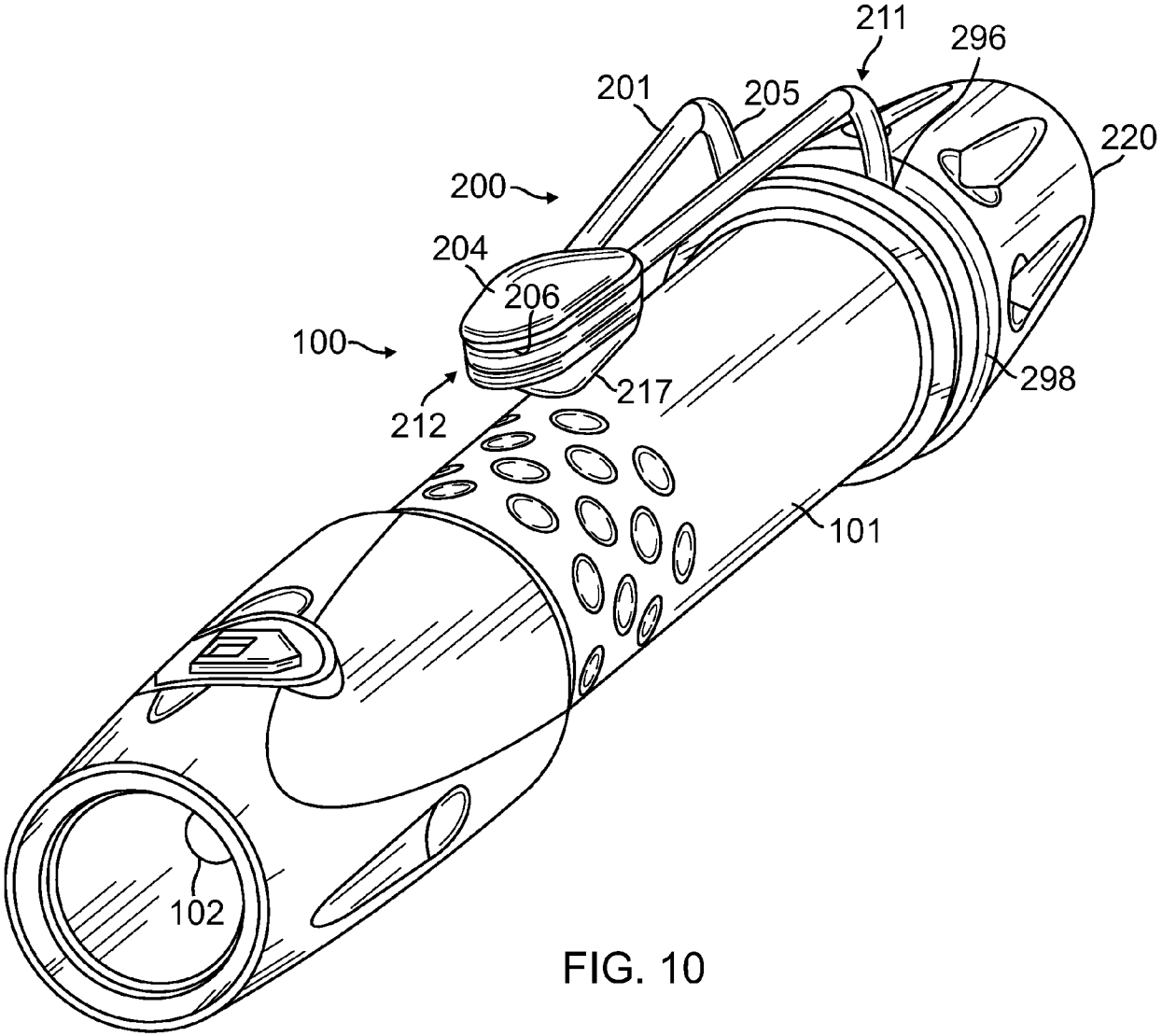
FIGS. 10-17 show a second configuration of a light producing device having a removable clip, in accordance with an embodiment of the invention.
Figure 11:
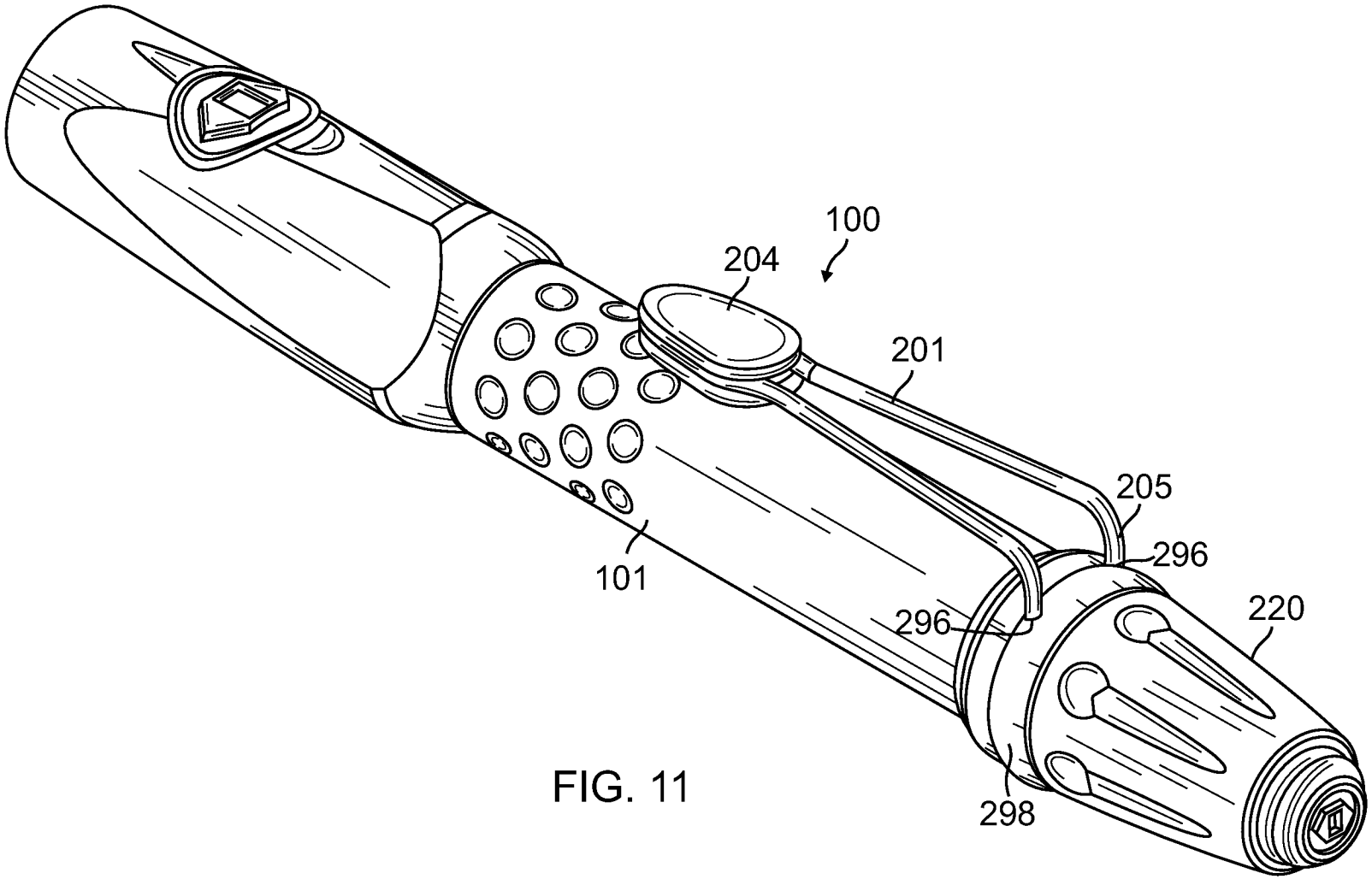
Figure 12:
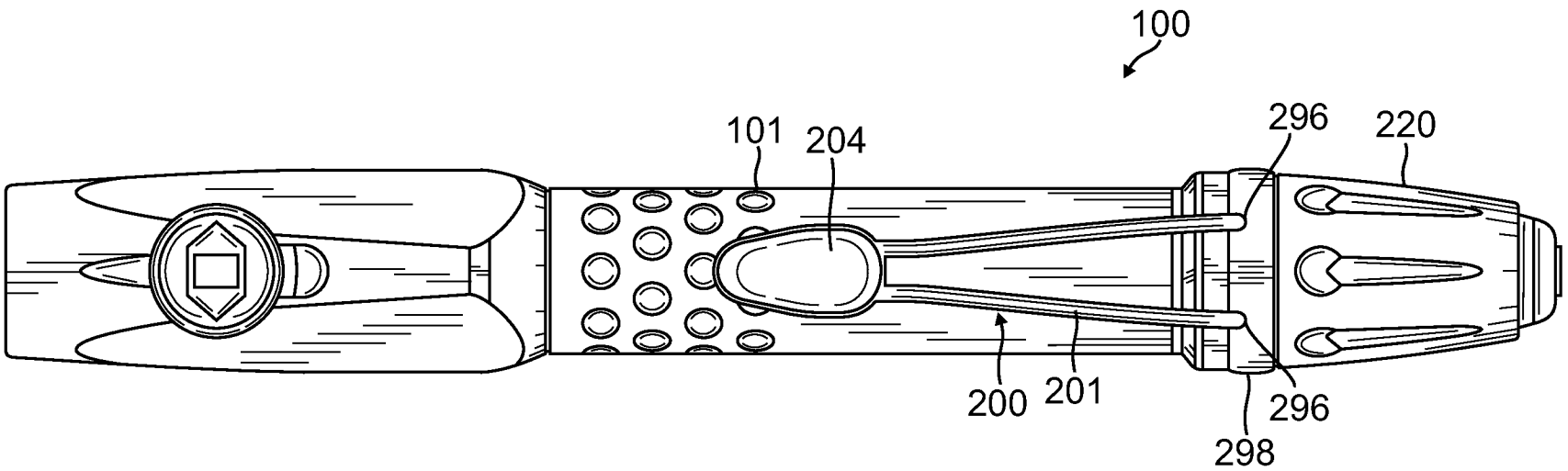
Figure 13:
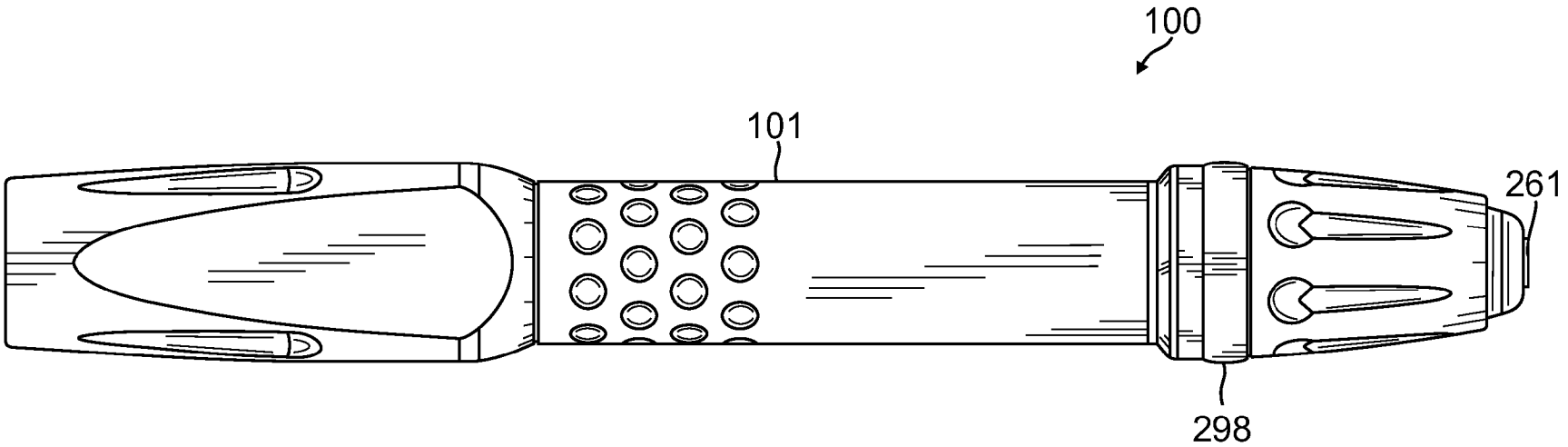
Figure 14:
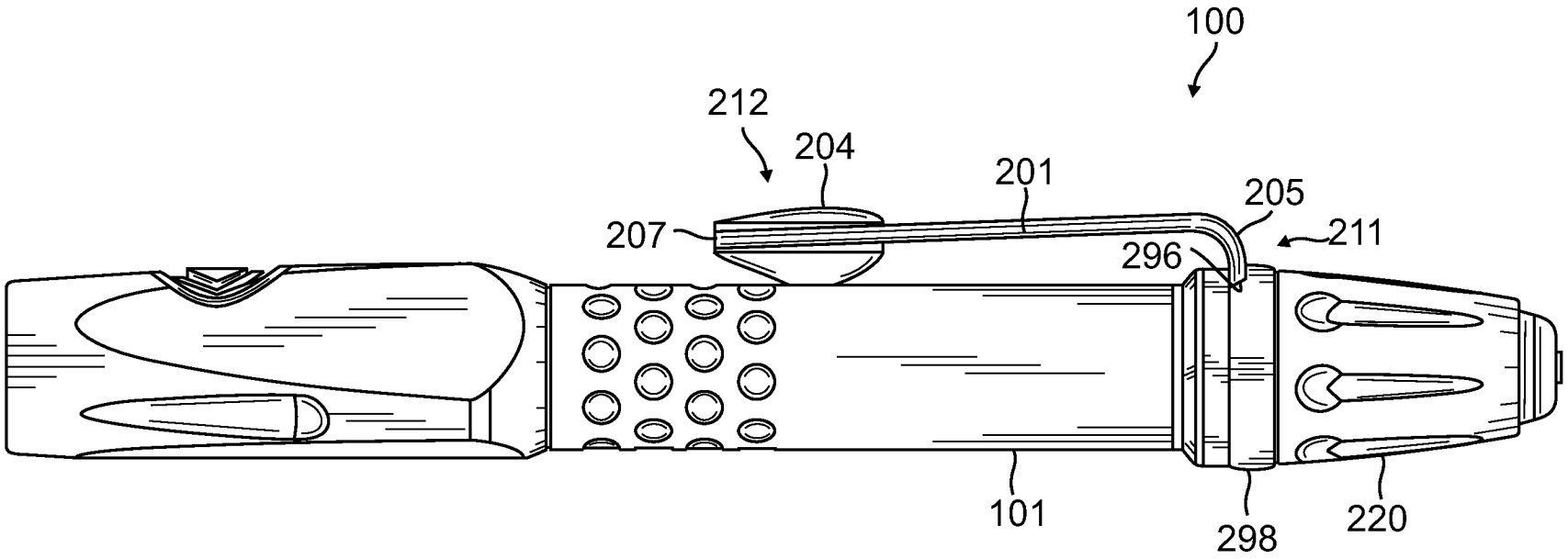
Figure 15:
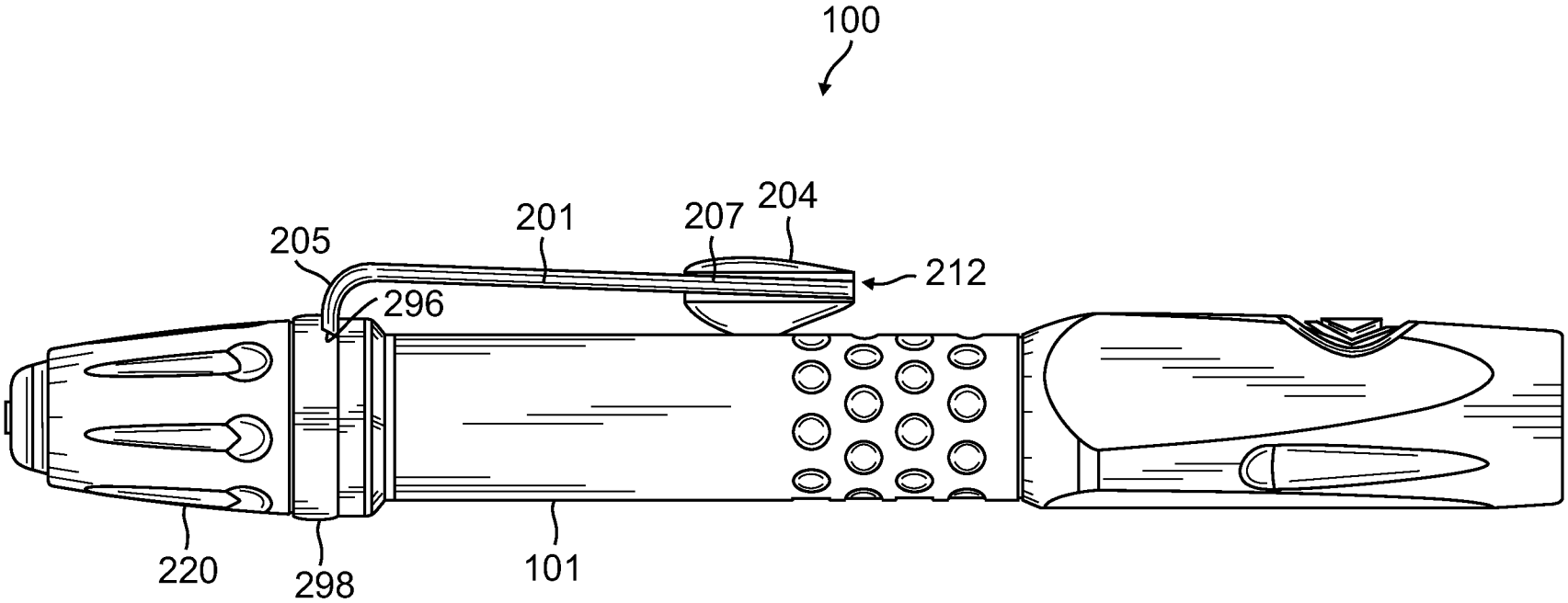
Figure 16:
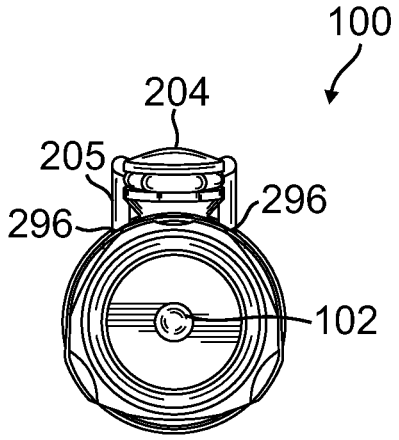
Figure 17:
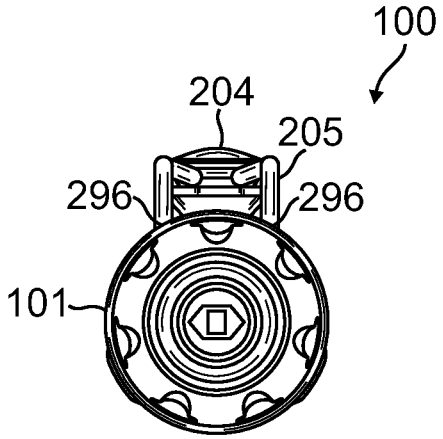

A power source 103 (as shown in FIG. 9), such as one or more batteries, may be contained within the body 101. Any number of batteries may be used. The power source 103 may provide power to the light source 102 and other components of light producing device 100. The light source may also provide power to other items, e.g., other light sources, a radio, or a telephone.

According to an embodiment, a clip 200 may be removably attachable to the body 101. The clip 200 may comprise an elongated portion 201 that may be attached to a split ring 202 (as shown in FIG. 9). The elongated portion 201 may be attached to the split ring 202 by an intermediate portion 205. The intermediate portion 205 and the split ring 202 may be generally co-planar with respect to one another and may both be generally orthogonal with respect to the elongated portion 201. Other configurations of the elongated portion 201, the intermediate portion 205 and the split ring 202 are contemplated.

The split ring 202 may comprise a gap or split 203. The split ring 202 may be configured such that the split 203 thereof may be spread or widened in a manner (e.g., by pulling elongated portion 201 away from body 101 or pushing elongated portion 201 toward body 101) that facilitates removal of the clip 200 from the body 201 and attachment of the clip 200 to the body 201. Widening the split 203 may substantially increase the diameter of the split ring 202 such that the split ring 202 more readily leaves the groove 221 and more readily slides over the body 101. The split ring 202 may be removed by sliding the split ring 202 forward (e.g., toward the light source 102 at the front of the light producing device 100) or by sliding the split ring rearward (e.g., toward a tail cap 220 or back of the light producing device 100).

The split 203 may be between approximately 0.1 mm and approximately 10 mm wide. The split 203 may be between approximately 1 mm and approximately 3 mm wide. For example, the split 203 may be approximately 1 mm, approximately 2 mm, or approximately 3 mm wild. The width of the split 203 may be between approximately 1/10 and approximately 1/3 of the diameter of the body 101. The width of the split 203 may be between approximately 1/6 and approximately 1/5 of the diameter of the body 101. The split 203 may have any desired width.

The split 203 may be capable of increasing in width such that the split ring 202 may slide forward and/or rearward off of the body 101. The split 203 may be capable of increasing in width such that the body 101 may pass through split 203 and the split ring 202 may thus be removed from the body 101 without sliding completely either forward and/or rearward off of the body 101. Thus, the split 203 may be capable of opening to a width that is equal to or larger than the diameter of the body 101, at least at one point along a length of the body 101.

The elongated portion 201 may have a proximal end 211 substantially where the intermediate portion 205 is disposed and may have a distal end 212 that may be substantially opposite the proximal end 211. The clip 200 may be attached to the light producing device 100 proximate the proximal end 211 thereof.

According to an embodiment, the clip 200 may be made by forming (e.g., bending) a single continuous section of wire, such as spring steel wire. The clip 200 may have any cross-section. For example, the clip 200 may have a generally circular, generally oval, generally square, generally rectangular, or generally triangular cross-section. Any other material or process may be used. For example, the clip 200 may be formed of a polymer material, such as by injection molding thereof.

A pad 204 may be disposed substantially at the distal end 212 of the elongated portion 201. The pad 204 may comprise a substantially resilient polymer material, such as rubber. Alternatively, the pad 204 may comprise a substantially non-resilient material, such as acrylonitrile butadiene styrene (ABS) or polycarbonate. As a further alternative, the pad 204 may comprise a metal such as aluminum or magnesium. The pad 204 may comprise a groove 206 (as shown in FIG. 1) that receives at least a portion of the distal end 212 to facilitate attachment of the pad 204 to the clip 200. The groove 206 may be formed generally circumferentially around the entire pad 204 or around a portion thereof.

The pad 204 may be made of a combination of different materials. For example, that portion of the pad 204 within which the groove 206 is formed may be made of a metal and a bottom 217 of the pad 204 may be formed of a resilient material.

The pad 204 may be attached to the clip 200 by snapping the distal end 212 of the clip 200 into the groove 206 of the pad 204. The pad 204 may be attached to the clip 200 by any other means. For example, the pad 204 may be molded to the clip 200 (such as by making the clip 200 an insert in an injection molding process). As further examples, the pad 204 may be adhesively bonded to the clip 200, ultrasonically welded to the clip 200, or attached to the clip 200 using one or more fasteners, e.g. screws.

The bottom 217 (as shown in FIG. 1) of the pad 204 may contact the body 101 or may be spaced apart therefrom. Thus, there may be a gap between the pad 204 and the body 101. The use of such a gap and/or the use of a resilient material for at least a portion of the pad 204 may facilitate movement of the distal end 212 of the clip 200 toward the body 101. The distance between the bottom 217 of the pad 204 and the body 101 may be sufficient to allow the clip 200 to be removed from the body 101 by pushing the distal end 212 (such as the pad 204) of the clip 200 toward the body 101 so as to cause the split 203 to increase in width sufficiently to facilitate removal of the clip 200 from the body 201. The pad 204 may be sufficiently resilient so as to facilitate such removal whether or not there is a gap between the pad 204 and the body 101. Thus, the pad 204 and any gap may cooperate to facilitate such removal.

Thus, the split ring 202 may be configured such that pushing the distal end 212, e.g., the pad 204, toward the body 101 causes the split 203 to open further so as to facilitate removal of the clip 200 from the body 101. The distal end 212 may be pushed toward the body 101 by squeezing the distal end 212 and the body between a thumb and forefinger of the user, for example.

For example, pushing the distal end 212 toward the body 101 may cause the clip 200 to rotate, see-saw, or rock about the split ring 202 proximate where the intermediate member 205 joins the split ring 202. In this manner, the split ring 202 may be levered such that the split 203 is widened and urged out of the groove 221.

The split ring 202 may be configured such that pulling the distal end 212, e.g., the pad 204, away from the body 101 causes the split 203 to open further so as to facilitate removal of the clip 200 from the body 101. The distal end 212 may be pulled away from the body 101 by grasping the distal end 212 with one hand and grasping the body 101 with the other hand and pulling, for example.

A tail cap 220 may attach to the body 101, such as by using threads 141 of the body 101 and complimentary threads within the tail cap 220. The tail cap 220 may define a tapered portion, such as a tapered portion of the body 101, over which the split ring 202 may slide during attachment and removal thereof with respect to the body 101.

The use of such a tapered portion may allow the split ring 202 to gradually expand so as to facilitate easier attachment thereof. Thus, attachment of the clip 200 to the body 101 is readily facilitated by simply sliding the split ring 202 over the tapered tail cap 220 so as to cause the split 203 to expand. Upon reaching the groove 221, the split ring 202 will drop or snap thereinto.

Thus, the split ring 202 may be received within a groove 221 formed at least partially in the body 101. The body 101 and the tail cap 220 may cooperate to define the groove 221 or the groove 221 may be formed solely by the body 101, as discussed herein.

Referring now to FIGS. 10-17, a second configuration of a light producing device 100 is shown according to an embodiment. The light producing device 100 may include various additional components 299 which may be used to implement a flashlight or pen light, for example (see FIG. 9). Thus, circuitry to support operation of light producing device 100, provide structural support for light producing device 100, and/or other features may be provided in light producing device 100.

With particular reference to FIG. 9, the clip 200 may be formed by bending steel wire, such as spring steel wire, to define a generally continuous (with the exception of the split 203) structure having a head 207 at the distal end 212 thereof and having the split ring 202 at the proximal end 211 thereof, according to an embodiment. The elongated portion 201 may define a lever that may be manipulated so as to facilitate removal and/or attachment of the clip 200 with respect to the body 101.

A pushbutton switch 261 may be used to apply electrical power from the power source 103 to the light source 102. The light source 102 may be contained within a lamp assembly 262. A lens 263 may cover the lamp assembly 262. A logo 264 may be formed separately and attached to the body 101 or to any other portion of the light producing device 100, such as at a complimentary recess 265. Alternatively, the logo 264 may be formed integrally with the body 101.

According to an embodiment, the light producing device 100 may also include a ring 298 which partially defines the groove 221. The ring 298 may be threaded onto the body 101. The ring 298 may abut or engage the split ring 202. A gasket 297 may be provided for the tail cap 220.

In various embodiments, the ring 298 may substantially and/or completely encircle proximal end 211 and/or split ring 202 when the tail cap 220 is attached to the body 101 by the threads 141 and 220. In such embodiments, the intermediate portion 205 may protrude from one or more cutouts or apertures 296 in the ring 298. Also in such embodiments, the removable clip 200 may be removed from light producing device 100 by at least partially unscrewing the tail cap 220 from body 101 enough such that removable clip may be pulled away from the body 101 and removed from the light producing device 100.

In an embodiment, all parts of the light producing device 100 may be replaceable. The use of the removable clip 200 readily facilitates replacement of parts of the light producing device 100.

According to an embodiment, the back end (that portion of the body that is generally opposite the end from which light is emitted) of the light producing device 100 may comprise a substantially conical or tapered portion. As discussed herein, once the split ring 202 of the removable clip 200 has been moved to the tapered portion, it may easily slip on or off of the body 101.

The light producing device 100 may comprise a flashlight, pen light, weapon mountable light, or any other type of light producing device. The light producing device may have a self-contained power supply, e.g., batteries, or may have an external power supply.

The light producing device may have any combination of self-contained (internal) and external power supplies.

The clip 200 may be readily removed from the body 101, such as to better facilitate hand holding of the light producing device 100, to facilitate maintenance and/or repair of the light producing device 100, or for storage/transportation of the light producing device 100.

Although a particular configuration of the clip 200 has been described, one or more other clip configurations may be used where appropriate. For example, the clip 200 may be larger and the distal end 212 thereof may be space farther from the body 101 to provide attachment of the light producing device 200 to a belt, helmet or firearm.

The discussion of particular light sources herein is by way of example only and not by way of limitation. Any number and wavelengths of light sources may be used (e.g., white light sources, infrared light sources, ultraviolet light sources, or other light sources). Such light sources may be grouped in any desired manner. For example, one group may include only white light sources that cooperate to provide white light when white light is selected and another group may include only infrared light sources that cooperate to provide infrared light when infrared light is selected.

Embodiments are not limited to the use of LEDs as light sources. Light sources other than LEDs may be used. For example, light sources such as LEDs, arc lamps, tungsten lamps, incandescent lamps, fluorescent lamps, or any other type of light sources may be used. Thus, discussion herein regarding the use of LEDs is by way of example only and not by way of limitation. Embodiments may include any desired light sources or combination of light sources.

Embodiments are not limited to use in either hand held or weapon mounted light producing devices. Discussion herein of hand holding and weapon mounting is by way of example only and not by way of limitation. Embodiments may be configured for use with flashlights, weapon (such as rifles and pistols) mounted lights, helmet mounted lights, headlamps, and vehicle lights. Indeed, embodiments may be used with any desired device. Thus, embodiments may provide light source switching for a variety of different applications. For example, the lighting device described herein may be configured to mount to a flashlight, a rifle or pistol, a helmet, a vehicle, or any other item. The lighting device may mount to such items via threads, mounts, adapters, or other appropriate ways.

The disclosure is not intended to limit the present invention to the precise forms or particular fields of use disclosed. It is contemplated that various alternate embodiments and/or modifications to the present invention, whether explicitly described or implied herein, are possible in light of the disclosure. For example, it is contemplated that the various embodiments set forth herein may be combined together and/or separated into additional embodiments where appropriate.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A light producing device comprising:
a body;
a light source attached to the body; and
a clip removably attached to the body, the clip comprising:
a split ring substantially encircling the body and having a split therein,
an elongated portion having a proximal end and a distal end, the elongated portion being attached to the split ring substantially opposite the split, and
wherein the clip is configured such that pushing the distal end of the elongated portion toward the body causes the split to open further so as to facilitate removal of the clip from the body.

2. The light producing device as recited in claim 1, wherein the clip is configured such that pulling the distal end of the elongated portion away from the body causes the split to open further so as to facilitate removal of the clip from the body.

3. The light producing device as recited in claim 1, wherein the body comprises a groove within which the split ring is at least partially disposed.

4. The light producing device as recited in claim 3, wherein the groove is only partially defined by the body.

5. The light producing device as recited in claim 3, further comprising a tail cap, wherein the groove is partially defined by the body and is partially defined by a ring that is attachable to the body, wherein the clip is configured to be removed from the body when the tail cap is at least partially unscrewed from the body.

6. The light producing device as recited in claim 1, wherein the body comprises a tapered portion proximate a back end of the body that more readily facilitates removal and/or attachment of the clip with respect to the body.

7. The light producing device as recited in claim 1, wherein the clip is made at least partially from single continuous piece of wire.

8. The light producing device as recited in claim 1, wherein the clip is made from spring steel.

9. The light producing device as recited in claim 1, wherein the clip further comprises a pad disposed proximate the distal end thereof.

10. The light producing device as recited in claim 1, wherein the body and the light source at least partially define a pen light.

11. A method for making light producing device, the method comprising:
providing a body;
attaching a light source to the body; and
removably attaching a clip to the body, the clip comprising:
a split ring configured to substantially encircle the body and having a split therein,
an elongated portion having a proximal end and a distal end, the elongated portion being attached to the split ring substantially opposite the split, and
wherein the clip is configured such that pushing the distal end of the elongated portion toward the body causes the split to open further so as to facilitate removal of the clip from the body.

12. The method as recited in claim 11, wherein the clip is configured such that pulling the distal end of the elongated portion away from the body causes the split to open further so as to facilitate removal of the clip from the body.

13. The method as recited in claim 11, wherein the body comprises a groove within which the split ring is at least partially disposed.

14. The method as recited in claim 13, wherein the groove is only partially defined by the body.

15. The method as recited in claim 13, wherein the groove is partially defined by the body and is partially defined by a ring that is attachable to the body, the method further comprising at least partially unscrewing a tail cap of the light producing device from the body to permit the clip to be removed from the body.

16. The method as recited in claim 11, wherein the body comprises a tapered portion proximate a back end of the body that more readily facilitates removal and/or attachment of the clip with respect to the body.

17. The method as recited in claim 11, wherein the clip is made at least partially from single continuous piece of wire.

18. The method as recited in claim 11, wherein the clip is made from spring steel.

19. The method as recited in claim 11, wherein the clip further comprises a pad disposed proximate the distal end thereof.

20. The method as recited in claim 11, wherein the body and the light source at least partially define a pen light.

* * * * *